US011473853B2

(12) United States Patent
Knudsen et al.

(10) Patent No.: US 11,473,853 B2
(45) Date of Patent: Oct. 18, 2022

(54) HEAT EXCHANGER PLATE

(71) Applicant: Danfoss A/S, Nordborg (DK)

(72) Inventors: Ivan Knudsen, Bjerringbro (DK); Helge Nielsen, Sydals (DK)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 17/090,444

(22) Filed: Nov. 5, 2020

(65) Prior Publication Data

US 2021/0140722 A1 May 13, 2021

(30) Foreign Application Priority Data

Nov. 7, 2019 (DK) ..... PA201901302

(51) Int. Cl.
*F28F 3/00* (2006.01)
*F28F 3/02* (2006.01)
*F28D 9/00* (2006.01)

(52) U.S. Cl.
CPC ..... *F28F 3/025* (2013.01); *F28D 9/0037* (2013.01)

(58) Field of Classification Search
CPC ..... F28F 3/025; F28F 3/10; F28D 9/0037
USPC ..... 165/166
See application file for complete search history.

(56) References Cited

U.S. PATENT DOCUMENTS 5,727,620 A * 3/1998 Schaufele ..... F28F 3/10 165/166
5,887,650 A * 3/1999 Yang ..... F28F 3/10 165/166
5,988,268 A * 11/1999 Usami ..... F28F 3/10 165/166
6,186,224 B1 * 2/2001 Seidel ..... F28F 3/10 165/166
6,464,101 B1 * 10/2002 Siragusa ..... B62D 25/24 220/795
6,513,584 B2 * 2/2003 Lehmann ..... F28F 3/10 165/166
6,935,415 B1 * 8/2005 Petersen ..... F28F 3/10 165/166
7,424,908 B2 * 9/2008 Blomgren ..... F28F 3/083 165/167
9,217,608 B2 * 12/2015 Krantz ..... F28F 3/10
(Continued)

FOREIGN PATENT DOCUMENTS

CN 1355879 A 6/2002
CN 1748119 A 3/2006
(Continued)

OTHER PUBLICATIONS

Extended European Search Report for European Patent Application No. 20 19 2690 dated Jan. 27, 2021.

*Primary Examiner* — Claire E Rojohn, III
(74) *Attorney, Agent, or Firm* — McCormick, Paulding & Huber PLLC

(57) ABSTRACT

A heat exchanger plate (1) is described comprising an edge (2), a groove (3) running along the edge (2), and a corrugated area (4) having tops (5) and valleys (6) between the groove (3) and the edge (2), wherein the tops (5) run substantially perpendicular to the edge (2) and the groove (3) comprises an external wall (7) adjacent to the corrugated area (4) and an internal wall (8). Using such a heat exchanger plate (1) it should be possible to produce a reliable plate-type heat exchanger of simple construction. To this end the external wall (7) is in form of a wavy shape.

20 Claims, 4 Drawing Sheets

(56) References Cited

U.S. PATENT DOCUMENTS

| | | | | |
|---|---|---|---|---|
| 10,451,361 | B2 * | 10/2019 | Rasmussen | F28F 3/10 |
| 2011/0259561 | A1 * | 10/2011 | Krantz | F28F 3/046<br>165/168 |
| 2017/0131035 | A1 | 5/2017 | Honnorat et al. | |

FOREIGN PATENT DOCUMENTS

| | | | |
|---|---|---|---|
| DE | 199 00 629 | A1 | 7/1999 |
| EP | 2361365 | B1 | 10/2015 |
| GB | 668905 | A | 3/1952 |
| JP | H04-217794 | A | 8/1992 |
| RU | 2 246 673 | C2 | 2/2005 |
| RU | 2 282 124 | C2 | 8/2006 |
| WO | 2010/092556 | A1 | 8/2010 |

* cited by examiner

HEAT EXCHANGER PLATE

CROSS-REFERENCE TO RELATED APPLICATION

This application claims foreign priority benefits under 35 U.S.C. § 119 to Danish Patent Application No. PA201901302 filed on Nov. 7, 2019, the content of which is hereby incorporated by reference in its entirety.

TECHNICAL FIELD

The present invention relates to a heat exchanger plate comprising an edge, a groove running along the edge, and a corrugated area having tops and valleys between the groove and the edge, wherein the tops run substantially perpendicular to the edge and the groove comprises an external wall adjacent to the corrugated area and an internal wall.

BACKGROUND

Such a heat exchanger plate is known, for example, from EP 2 361 365 B1.

The invention is in particular used for a high-pressure heat exchanger having a stack of such heat exchanger plates, wherein a gasket is arranged between two adjacent plates. The corrugated area along the edge forms contact points to the adjacent plates of the stacks.

However, such a construction has the risk that a gap is formed into the cavity formed inside the outer wall of the groove. At high pressure the gasket which is accommodated in the groove tends to be pushed towards this cavity, thus making the heat exchanger leak.

SUMMARY

The object underlying the invention is to have a reliable plate-type heat exchanger of simple construction.

This object is solved with a heat exchanger plate as described at the outset in that the external wall is in form of a wavy shape.

The wavy shape of the external wall varies the size of the gap or, in a preferred embodiment, makes the gap so small that the gasket cannot be pressed out of the groove. Thus, the risk of a leakage of the heat exchanger formed by such heat exchanger plates is dramatically reduced.

In an embodiment of the invention the wavy shape comprises crests and troughs, wherein the crests are closer to the edge than the troughs and wherein at least in a middle section of the edge the number of crests corresponds to the number of tops. Thus, it is possible to reduce the size of the gap at each top.

In an embodiment of the invention the crests are arranged in the region of the tops. Thus, the gap is reduced exactly in the position, where it is need.

In an embodiment of the invention the crests extend at least to an internal border of the corrugated area. In particular, it is possible that the crests extend beyond the internal border of the corrugated area. Thus, it is possible to close the gap completely.

In an embodiment of the invention the groove comprises a varying width. This varying width is due to the fact that the external wall is in form of a wavy shape and that the internal wall does not follow the same shape.

In an embodiment of the invention the internal wall is straight at least over a part of its length. This simplifies the production of the heat exchanger plate.

In an additional or alternative embodiment of the invention the internal wall is not straight at least over a part of its length. However, it is possible to combine straight parts and non-straight parts of the internal wall. The particular form of the internal wall depends on the gasket used.

In an embodiment of the invention the crests and troughs are rounded. Thus, there are no sharp edges which could damage the gasket.

In an embodiment of the invention the crests and troughs are in form of a sinusoidal wave. A sinusoidal wave is a harmonic form keeping low stresses on the gasket.

In another embodiment of the invention the crests and troughs are squared. This simplifies the production of the heat exchanger plate.

BRIEF DESCRIPTION OF THE DRAWINGS

An embodiment of the invention will now be described in more detail with reference to the drawing, wherein.

DETAILED DESCRIPTION

Figure 1:
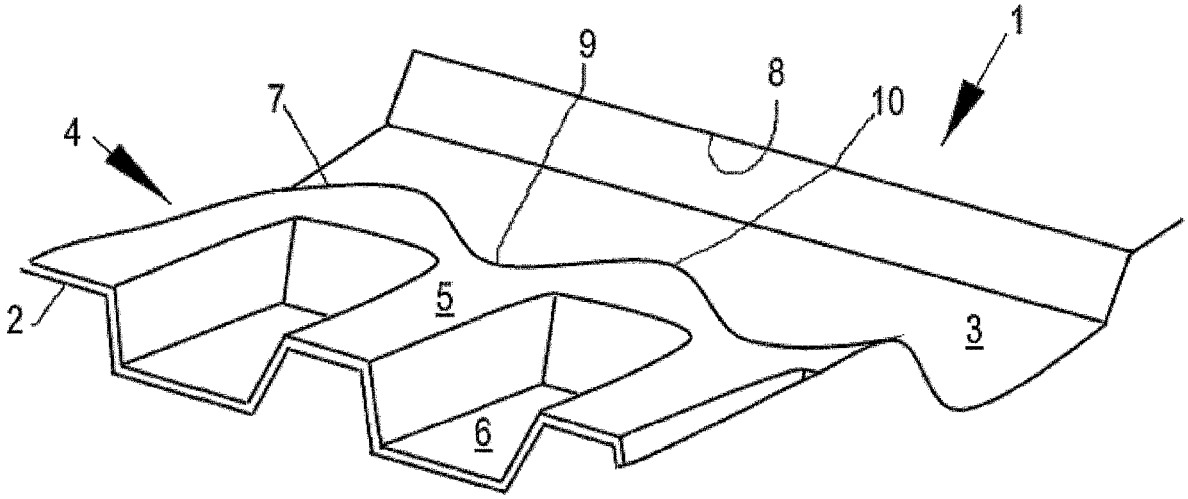
FIG. 1 shows a perspective view of an edge section of a heat exchanger plate.

In all Figures the same elements are denoted with the same reference numerals.

FIG. 1 shows in a perspective view an edge section of a heat exchanger plate 1 comprising an edge 2, a groove 3 running parallel to the edge 2, and a corrugated area 4 having tops 5 and valleys 6 between the groove 3 and the edge 2.

The tops 5 run substantially perpendicular to the edge 2. The groove 3 comprises an external wall 7 adjacent to the corrugated area 4 and an internal wall 8 on the opposite side of the external wall 7.

The external wall 7 is in form of a wavy shape, i.e. it is ondulated. The external wall 7 comprises crests 9 and troughs 10. The crests 9 are closer to the edge 2 than the troughs 10.

At least in a middle section of the edge 2 the number of crests 9 corresponds to the number of tops 5.

Crests 9 are arranged in the region of the tops 5. In a preferred embodiment a point of the crests 9 closest to the edge 2 corresponds to a middle (in a direction parallel to the edge 2) of the top 5.

The crests 9 extend as close as possible to the top 5. In the embodiment shown, there is a small distance A between an internal border 11 of the corrugated area 4 and the crests 9 of the internal wall 7. However, it is possible that the crests 9 extend at least to the internal border 11 of the corrugated area 4.

Due to the wave shape of the external border 7 the width of the groove 3 varies. In other words, the distance between the external wall 7 and the internal wall 8 varies.

In the embodiment shown, the internal wall 8 is straight. However, it is possible to use an internal wall 8 which is straight only over a part of its length or which is not straight. It is in addition possible to combine sections of the internal wall 8 being straight and sections of the internal wall which are not straight.

The crests 9 and troughs 10 are rounded. It is possible to design the external wall 7 in form of a sinusoidal wave or to design the external wall in a succession of squares or rectangles.

Figure 2:
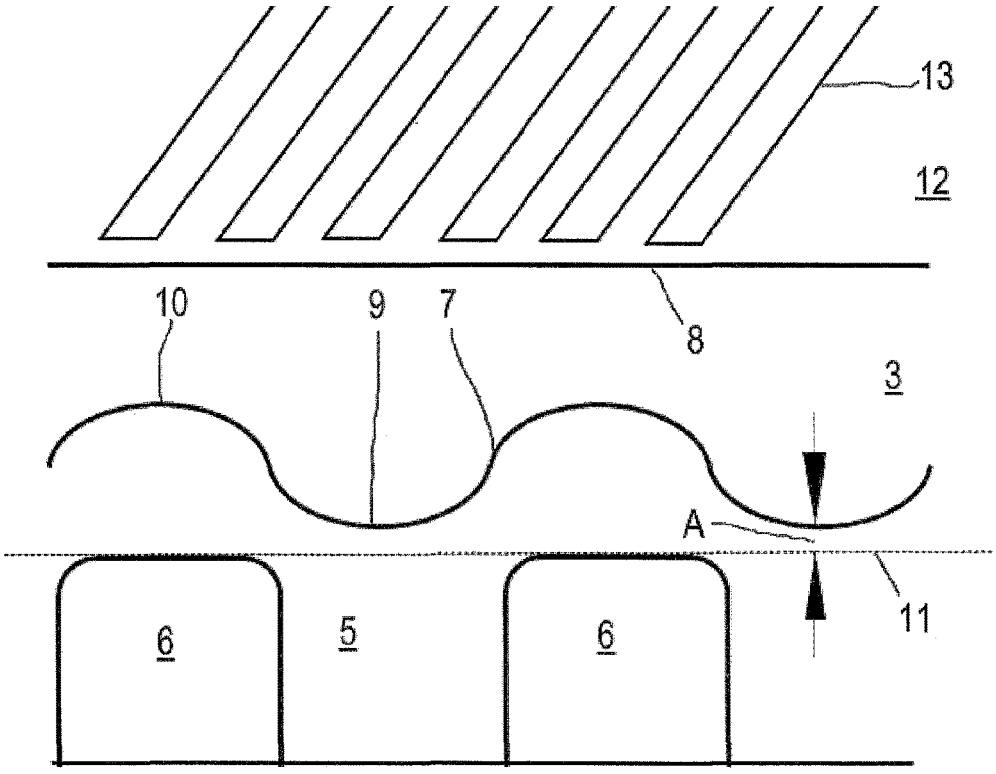
FIG. 2 shows a top view of the edge section of the heat exchanger plate according to FIG. 1.

FIG. 2 shows in addition a heat exchanging area 12 of the heat exchanger plate 1 having a herring bone pattern 13.

Figure 3:
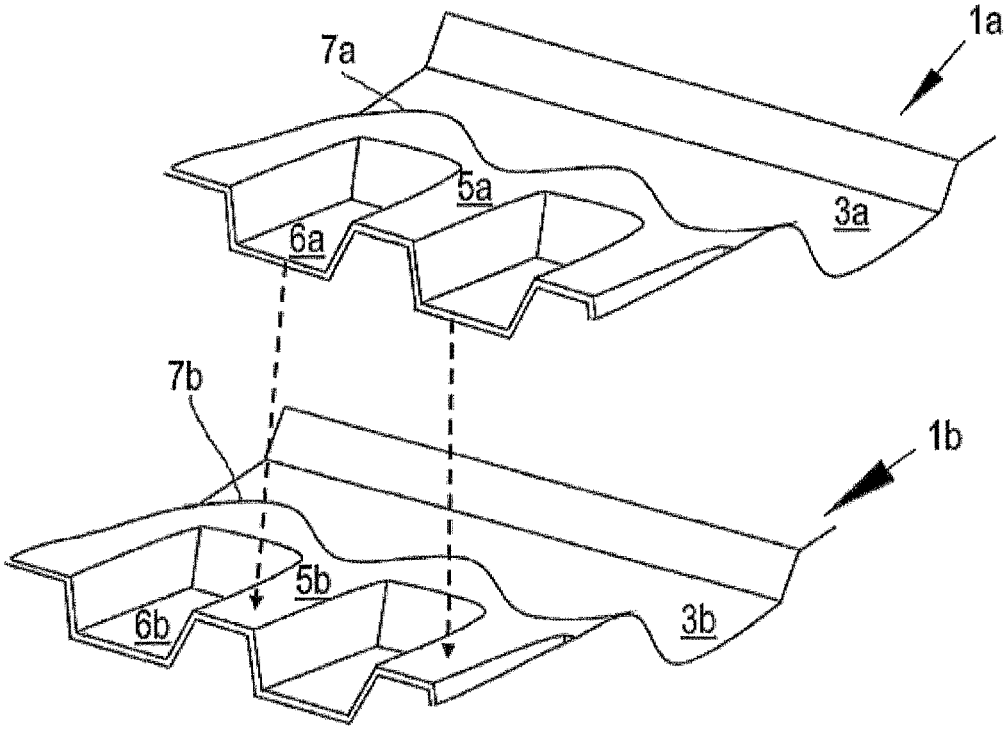
FIG. 3 shows a perspective view of edge sections of two heat exchanger plates during assembling, FIG. 4 schematically illustrates a relation between a corrugated area at the edge and the wave shape of the external wall, FIG. 5*a* schematically shows the relation of the crests and tops of the assembly of two heat exchanger plates 1*a*, 1*b* of a second embodiment according to FIG. 4.

FIG. 3 shows schematically, how two heat exchanger plates 1*a*, 1*b* are mounted to each other. The valleys 6*a* of the upper heat exchange plate 1*a* are mounted onto the tops 5*b* of the lower heat exchanger plate 1*b*.

Figure 4:
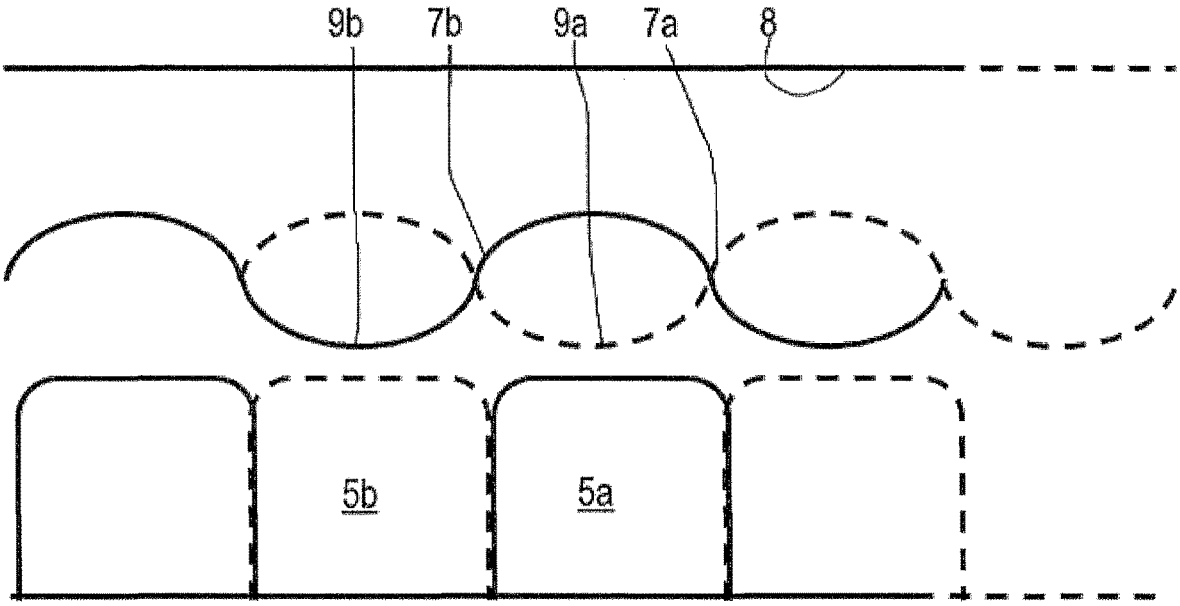

FIG. 4 schematically shows the relation of the crests and tops of the assembly of the two heat exchanger plates 1*a*, 1*b*. Parts of the upper heat exchanger plate 1*a* are shown with dotted lines and the corresponding parts of the lower heat exchanger plate 1*b* are shown in full lines.

It can be seen that the crests 9*b* of the external wall 7*b* of the lower heat exchanger plate 1*b* extend to the tops 5*b* of the lower heat exchanger plate 1*b*, whereas the crests 9*a* of the external wall 7*a* of the upper heat exchanger plate 1*a* extend to the tops 5*a* of the upper heat exchanger plate 1*a*.

The distance A mentioned above is chosen to be so small that a gasket which is arranged in the groove 3 cannot be pressed through the gap. The smaller the distance A, the smaller the gap and the lower is the risk that leakages occur.

Figure 5B:
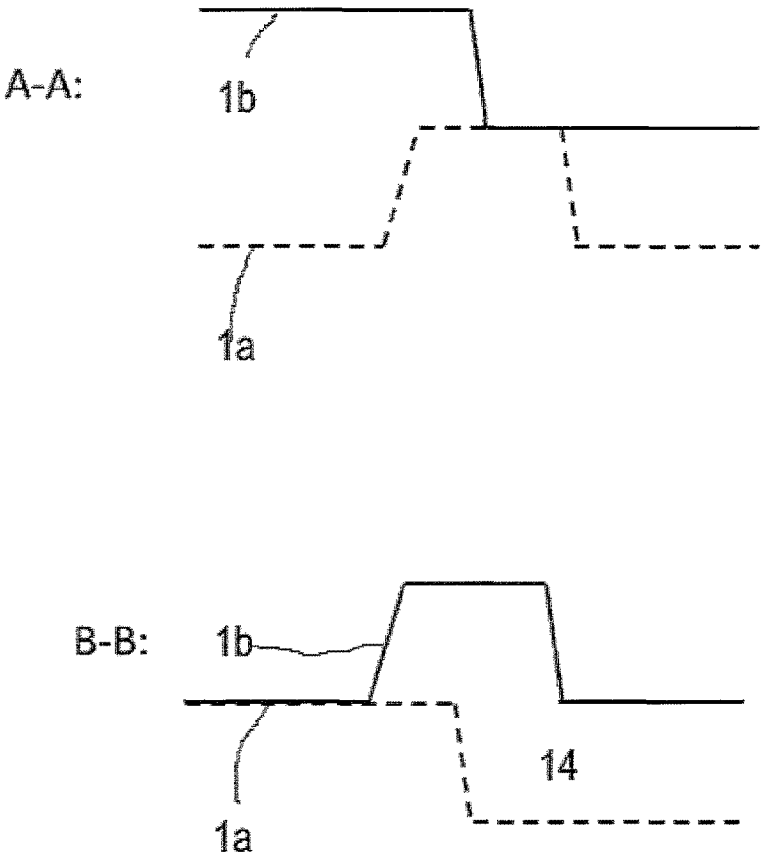
FIG. 5*b* shows sectional views along the lines A-A and B-B of FIG. 5*a*, FIG. 6*a* schematically shows a top view of a third embodiment according to FIG. 4.
Figure 5A:
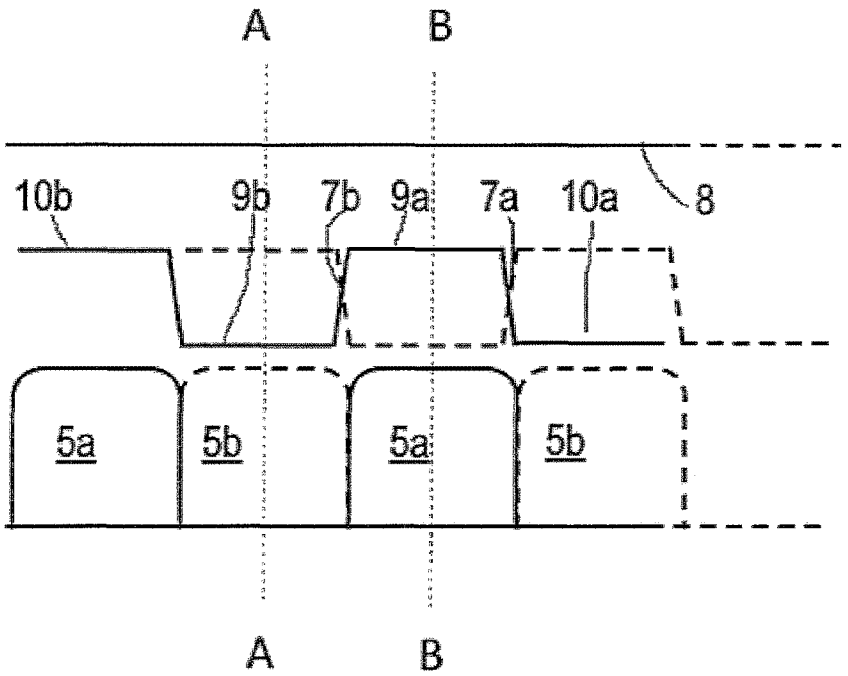

FIG. 5*a* shows the relation of the crests and tops of the assembly of two heat exchanger plates 1*a*, 1*b* of a second embodiment. Parts of the upper heat exchanger plate 1*a* are shown with dotted lines and the corresponding parts of the lower heat exchanger plate 1*b* are shown in full lines.

The wavy shape of the external wall 7 is squared or almost squared rather than sine-shaped, like in FIG. 4.

FIG. 5*b* shows sectional views along the lines A-A and B-B of FIG. 5*a*. It can be seen that in section A-A the gap has disappeared.

FIG. 6 shows schematically the relation of the crests and tops of the assembly of two heat exchanger plates 1*a*, 1*b* of a third embodiment.

Figure 6B:
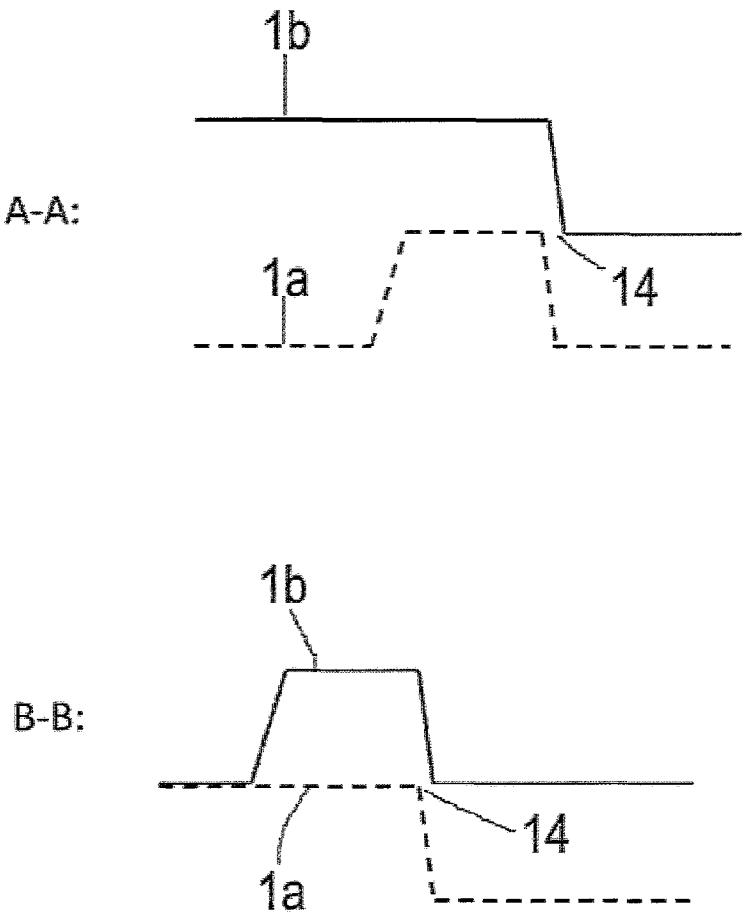
FIG. 6*b* shows sectional views along lines A-A and B-B of FIG. 6*a*.
Figure 6A:
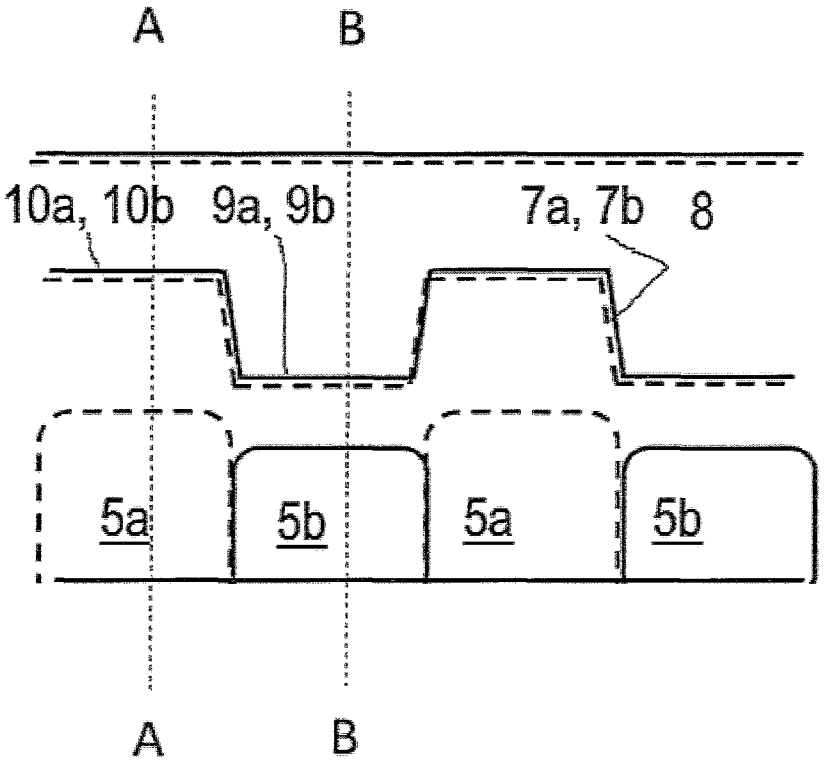

FIG. 6*a* shows a top view and FIG. 6*b* shows sectional views along lines A-A and B-B of FIG. 6*a*.

The shape of the border lines 7*a*, 7*b* are illustrated as squared, but can also be of a sin-shape or any other curvy form. The shapes are shifted.

It can be seen that the gap 14 between the two plates 1*a*, 1*b* have almost disappeared and is so small that there is no risk that a gasket will be pressed through. In this embodiment the two border lines 7*a*, 7*b* are at least almost identical. In other words, the border lines are shifted in relation to each other when compared to the embodiment of FIGS. 4 and 5.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A heat exchanger comprising:

an upper heat exchange plate positioned above a lower heat exchanger plate, each heat exchanger plate having:

an edge extending in a first direction, a groove running in the first direction, the groove comprising an external wall and an internal wall, and an edge area extending between the external wall of the groove and the edge, wherein the external wall is in the form of a wavy shape having crests and troughs, and wherein when the upper heat exchanger plate is arranged above the lower heat exchanger plate, the crests of the external wall of the upper heat exchanger plate are offset in the first direction from the crests of the external wall of the lower heat exchanger plate.

2. The heat exchanger according to claim 1, wherein the edge area is a corrugated area having tops and valleys extending between the external wall of the groove and the edge, and wherein the crests are closer to the edge than the troughs and wherein at least in a middle section of the edge there is an equal number of crests and of tops.

3. The heat exchanger according to claim 2, wherein the crests are arranged in a region of the tops.

4. The heat exchanger according to claim 3, wherein the crests extend at least to an internal border of the corrugated area.

5. The heat exchanger according to claim 1, wherein the groove comprises a varying width.

6. The heat exchanger according to claim 1, wherein the internal wall is straight at least over a part of a length of the internal wall.

7. The heat exchanger according to claim 1, wherein the internal wall is not straight at least over a part of a length of the internal wall.

8. The heat exchanger according to claim 1, wherein the crests and troughs are rounded.

9. The heat exchanger according to claim 8, wherein the crests and troughs are in the form of a sinusoidal wave.

10. The heat exchanger according to claim 8, wherein the crests and troughs are squared.

11. The heat exchanger according to claim 4, wherein the groove comprises a varying width.

12. The heat exchanger according to claim 2, wherein the internal wall is straight at least over a part of a length of the internal wall.

13. The heat exchanger according to claim 3, wherein the internal wall is straight at least over a part of a length of the internal wall.

14. The heat exchanger according to claim 4, wherein the internal wall is straight at least over a part of a length of the internal wall.

15. The heat exchanger according to claim 5, wherein the internal wall is straight at least over a part of a length of the internal wall.

16. The heat exchanger according to claim 2, wherein the internal wall is not straight at least over a part of a length of the internal wall.

17. The heat exchanger according to claim 3, wherein the internal wall is not straight at least over a part of a length of the internal wall.

18. The heat exchanger according to claim 4, wherein the internal wall is not straight at least over a part of a length of the internal wall.

19. The heat exchanger according to claim 5, wherein the internal wall is not straight at least over a part of a length of the internal wall.

20. The heat exchanger according to claim 2, wherein the valleys of the upper heat exchanger plate are arranged above the tops of the lower heat exchanger plate.

* * * * *